US006035892A

United States Patent [19]

Kennedy

[11] Patent Number: 6,035,892

[45] Date of Patent: Mar. 14, 2000

[54] TELESCOPING VALVE HAVING IMPROVED SEAL

[75] Inventor: Paul G. Kennedy, Horseheads, N.Y.

[73] Assignee: Penn Troy Machine Co., Inc., Troy, Pa.

[21] Appl. No.: 09/137,192

[22] Filed: Aug. 20, 1998

[51] Int. Cl.[7] ..... E03B 11/00

[52] U.S. Cl. ..... 137/590.5; 285/302

[58] Field of Search ..... 137/590, 590.5; 285/302, 298

[56] References Cited

U.S. PATENT DOCUMENTS 2,828,980 4/1958 Craig et al. ..... 285/302 X 5,280,876 1/1994 Kennedy ..... 251/144

5,715,859 2/1998 Nichols-Roy ..... 137/426

*Primary Examiner*—Charles E. Phillips

*Attorney, Agent, or Firm*—Brown, Pinnisi & Michaels, P.C.

[57] ABSTRACT

A telescoping seal uses a split resilient gasket surrounding the slide pipe at the bottom of the tank. The gasket has a slanting outer side, mating with a slanting seat in a lower flange which is attached to the bottom of the tank. An upper flange compresses the gasket downward into the seat, causing the gasket to be compressed inward around the slide pipe, thereby providing a watertight seal which still permits the vertical sliding motion of the slide pipe.

10 Claims, 2 Drawing Sheets

TELESCOPING VALVE HAVING IMPROVED SEAL

FIELD OF THE INVENTION

The invention pertains to the field of valves used for controlling fluid level. More particularly, the invention pertains to telescoping valves.

BACKGROUND OF THE INVENTION

Telescoping valves are used to control the level of fluid, for example in a storage or water treatment tank or the like. The valve comprises a vertical slide pipe (1) (also called a "slip tube"), the upper end (5) of which serves as a weir, and the lower end (6) of which extends through a hole (16) in the bottom of the tank (18) into a conduit of some kind. The slide pipe (1) can vary from several inches to several feet in diameter, and may be many feet high, depending on the application. When the water level is higher than the upper end (5) of the pipe, the water overflows into the pipe (1), and the level in the tank is maintained at the level of the weir (5). Commonly, the weir (5) is provided with V-shaped notches (4), permitting the water to begin flowing at an increasing rate as it approaches the top of the weir.

The slide pipe (1) can be raised or lowered by an actuating mechanism (which does not form part of the invention, and is not shown) which is attached to the top of the slide pipe (1), for example by a U-shaped bracket (3) which is attached to an actuating rod (2) or pipe. Actuation of the actuating mechanism raises and lowers the actuating rod (2), which in turn sets the height of the top (5) of the slide pipe (1) above the bottom (18) of the tank, and thus determines the water level in the tank.

Prior art telescoping valves are prone to leakage around the hole (16) where the slide pipe (1) passes into a pipe of larger diameter with a tank flange at the bottom (18) of the tank. Such leakage is expected, and it is not uncommon for a specification for a telescoping valve to contain a value for permissible leakage which is quite substantial. Often a large flat neoprene or rubber washer or gasket is used around the slide pipe as a wiper. The washer is typically held to the tank flange with a flat metal flange, which compresses the rubber to some extent. Such a wipe gasket can achieve a poor seal, at best, and both the slip tube and actuating mechanism must be removed from the drained tank to replace the gasket if such replacement is needed.

Mechanical Joint ("MJ") gaskets are normally used as a watertight packing in mechanical joint cast iron fittings, in installations where it is not possible to know the exact laying lengths of the pipe in advance. One end of a piece of pipe is inserted into a larger diameter section of pipe known as an "adjustable connecting piece". The MJ gasket is then squeezed into the gap between a tapered portion of the inner wall of the connecting piece and the outside wall of the pipe by a ring gland, forming a seal primarily on its inside straight walls. This application is completely different from the resilient valve seat in the present invention, the MJ gasket being used here purely for commercial ease of availability and economic reasons.

The present inventor has previously used an MJ gasket in a valve, as shown in U.S. Pat. No. 5,280,875 "RESILIENT SEAT MUD VALVE". Mud valves, however, are a different type of application than telescoping valves, in that the seal is used there to seal between a plug and a hole, as opposed to providing a replaceable leak-free sliding joint between a sliding pipe and a flange.

SUMMARY OF THE INVENTION

The invention comprises a telescoping valve using a split resilient gasket surrounding the slide pipe at the bottom of the tank. The gasket has a slanting outer side, mating with a slanting seat in a lower flange which is attached to the bottom of the tank. An upper flange compresses the gasket downward into the seat, causing the gasket to be compressed inward around the slide pipe, providing a watertight seal which still permits the vertical sliding motion of the slide pipe.

DESCRIPTION OF THE PREFERRED EMBODIMENT

Figure 1:
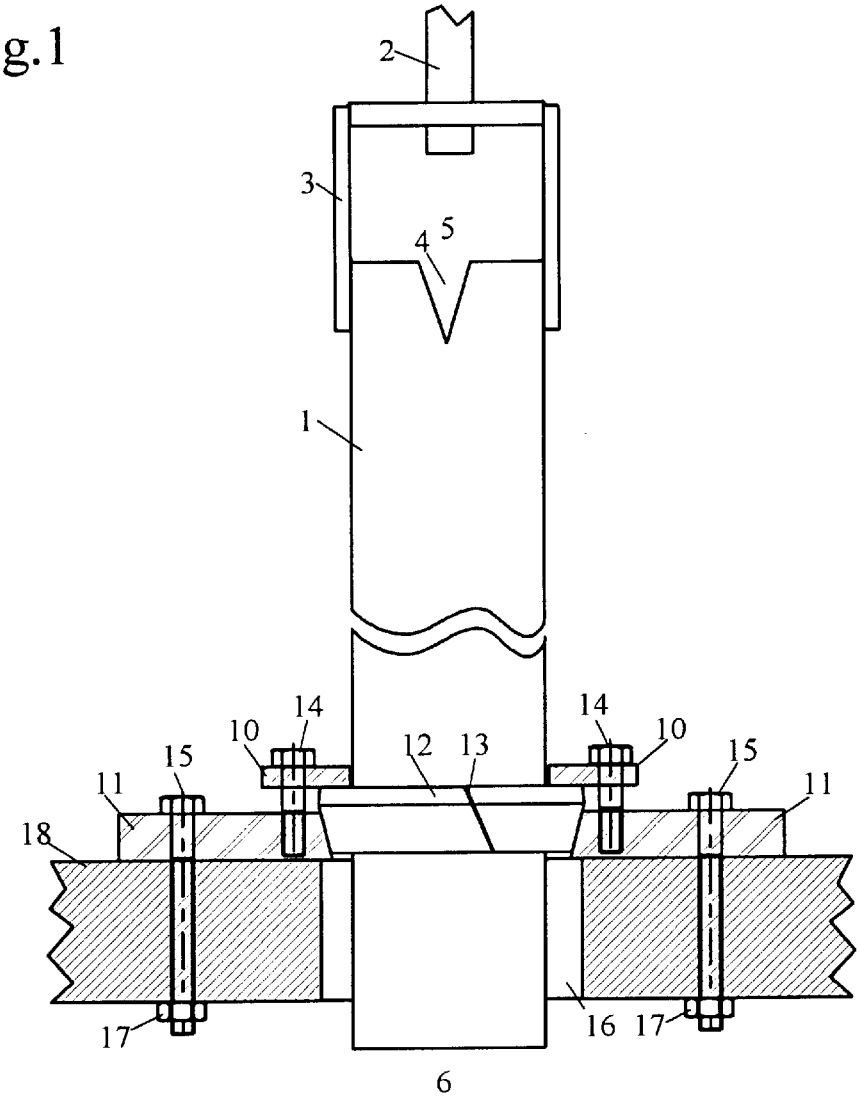
FIG. 1 shows a partially cut-away side view of the telescoping valve of the invention.
Figure 2:
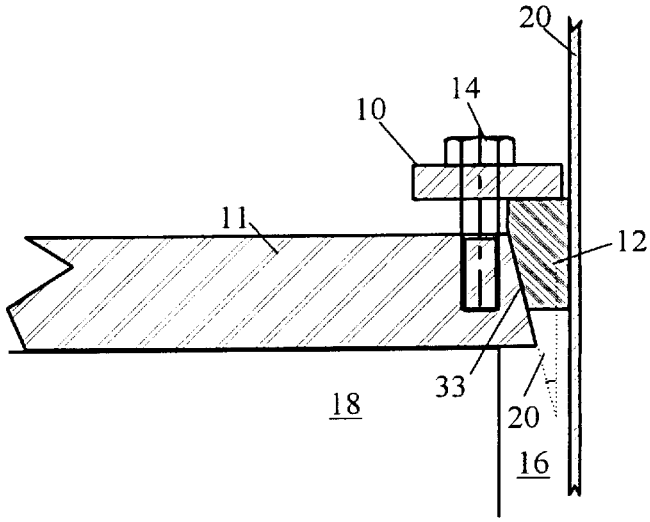
FIG. 2 shows a cut-away detail of the valve seal of the invention.
Figure 3:
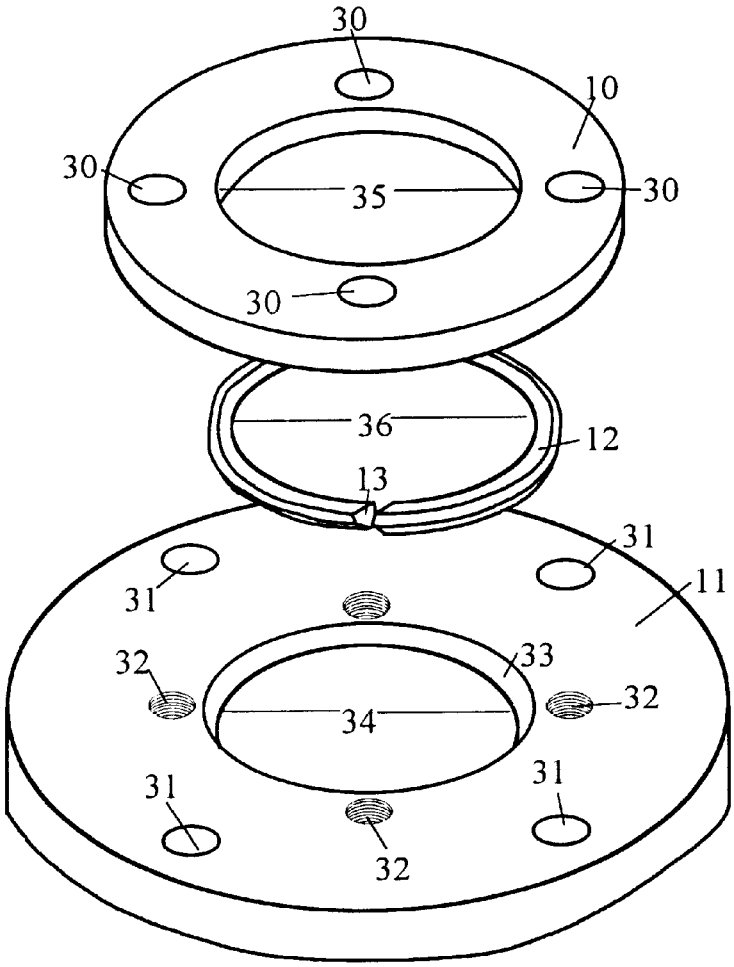
FIG. 3 shows a perspective view of the flanges and gasket of the invention.

The preferred embodiment of the invention is shown in FIG. 1 and in further detail in FIG. 2, which shows the details of the invention in the flanges and seal area, only. FIG. 3 shows the flanges and seal, in perspective view. The following discussion refers to all three figures, in which the reference numbers are consistent. The slide pipe and actuating rod arrangement is conventional and is shown for clarity only.

In the preferred embodiment of the invention, the improved seal is made up of an upper flange (10), a resilient seal or gasket (12) and a lower flange (11).

The upper flange has a straight-through inner bore (35), which is slightly larger in diameter than the outer diameter of the slide pipe (1), so that the flange may be slid freely down on the pipe (1). Several holes (30) are provided, which match up with threaded holes (32) in the lower flange (11), so that bolts (14) may pass through holes (30) and be threaded into holes (32), and tightened down.

The lower flange (11) is attached to the bottom of the tank (18) around the exit hole (16), as by bolts (15) fitting through holes (31) and secured by nuts (17), or other conventional means. The lower flange (11) has a center hole or inner bore (34) of sufficient diameter to clear the slide pipe (1). The inside diameter of the center hole (34) is tapered from top to bottom, forming a tapered seat (33), which preferably tapers at approximately a 28° angle (20). The minimum diameter of the inner bore, at the lower surface where the lower flange is in contact with the bottom of the tank, is at minimum slightly larger than the outer diameter of the slide pipe (1), so that the slide pipe (1) may pass freely through the flange.

Fitting within the seat (33) is a split ring gasket (12), made of a resilient material, such as rubber or some synthetic equivalent such as neoprene. The resilient gasket is roughly in the form of a right triangle, in which the plane of the outer surface (hypotenuse of the triangle) which forms the seal forms approximately a 28° angle (20) with the plane of the slide pipe (1). The seat may actually form a triangle or wedge (i.e. come to a point at its lower end), or it may alternately be truncated as shown in the drawings, so long as the extended planes of the two sides would meet at the approximate 28° angle preferred by the teachings of the invention. The inner diameter of the gasket is only slightly larger than the outer diameter of the slide pipe, so that it may be slid down the slide pipe into its seat (22).

In the preferred embodiment, it has been found that a standard mechanical joint pipe gasket (or "MJ gasket") can be used to form the 28° resilient seal. This has the advantage that MJ gaskets are commercially available in a wide variety of sizes, and are relatively inexpensive compared to custom-made seals. An example of an MJ gasket which can be incorporated into the preferred embodiment of the invention is the F-915, manufactured by Clow Corporation of Oak Brook, Ill., which is available in sizes from 6" to 30" in diameter.

In operation, then, the lower flange (11) is secured to the bottom of the tank (18), the gasket (12) is placed around the slide pipe (1) (or the slide pipe is inserted through the flanges and gasket), and the fastenings (14) ofthe upper flange (10) are tightened down, compressing the gasket or seal (12) in its tapered seat (33) around the outside of the slide pipe (1). Using the improved seal of the invention, it has been found that a practical telescoping valve can be fabricated with practically no leakage around the seal, in comparison with the substantial leakage around the wipers or packing of the prior art valves.

The gasket (12) is split (13), preferably on the diagonal relative to the circumference of the circle formed by the gasket, as shown in FIGS. 1 and 3. The split (13) allows the gasket seal (12) to be easily removed and replaced in the field without the necessity of draining the tank or removing the slide pipe (1). The upper flange (10) is simply raised up the slide pipe (1) by unscrewing bolts (14) from threaded holes (32), and the split gasket (12) can be pulled up and away from the slide pipe (1). A new gasket (12) is then slipped around the slide pipe (1), and seated in the tapered seat (33). The upper flange (10) is then slid back down again, and the bolts (14) replaced and tightened. Tightening bolts (14) compresses the resilient gasket (12) in the tapered seat (33), pressing it into contact on the periphery of the slide pipe (1), and eliminating leakage around the slide pipe (1).

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. An improved telescoping valve of the kind having a hollow cylindrical slide pipe with upper and lower ends, the slide pipe being slidably movable along its axis, such that the height of the upper end determines the level of fluid in a containment, the improvement comprising:

a) a lower flange for mounting to the bottom of the containment, having an upper surface and a lower surface and a thickness therebetween, and a cylindrical inner bore having a diameter which tapers from a maximum at the upper surface of the flange to a minimum at the lower surface, the minimum diameter of the inner bore being sufficiently larger than the outer diameter of the slide pipe such that the slide pipe may be inserted through the inner bore, free to move slidably through the bore;

b) an upper flange, coaxially located above the lower flange, having an upper surface and a lower surface and a thickness therebetween, and a cylindrical inner bore, the diameter of the inner bore being) sufficiently larger than the outer diameter of the slide pipe such that the slide pipe may be inserted through the inner bore, free to move slidably through the bore;

c) a cylindrical seal of resilient material, coaxially located between the upper flange and the lower flange, and extending into the inner bore of the lower flange, having an upper surface and a lower surface and a thickness therebetween, and a cylindrical inner bore, the diameter of the inner bore being sufficiently larger than the outer diameter of the slide pipe such that the slide pipe may be inserted through the inner bore, free to move slidably through the bore; the outer diameter of the cylindrical seal being tapered to match the taper of the inner bore of the lower flange; and d) compression means for fastening the upper flange to the lower flange, compressing the resilient seal therebetween, the tapered outer diameter of the resilient seal being pressed by the compression means into the tapered inner bore of the lower flange, such that the inner bore of the resilient seal is pressed against the outer diameter of the slide pipe.

2. The valve of claim 1, in which the resilient material of the cylindrical seal is rubber.

3. The valve of claim 1, in which the resilient material of the cylindrical seal is neoprene.

4. The valve of claim 1, in which the cylindrical seal is a mechanical joint pipe gasket.

5. The valve of claim 1, in which the inner bore of the lower flange and the outer diameter of the cylindrical seal are tapered at an angle of approximately 28° to the axis of the inner bore.

6. A seal assembly for a telescoping valve of the kind having a hollow cylindrical slide pipe with upper and lower ends, the slide pipe being slidably movable along its axis, such that the height of the upper end determines the level of fluid in a containment, comprising:

a) a lower flange for mounting to the bottom of the containment, having an upper surface and a lower surface and a thickness therebetween, and a cylindrical inner bore having a diameter which tapers from a maximum at the upper surface of the flange to a minimum at the lower surface, the minimum diameter of the inner bore being sufficiently larger than the outer diameter of the slide pipe such that the slide pipe may be inserted through the inner bore, free to move slidably through the bore;

b) an upper flange, coaxially located above the lower flange, having an upper surface and a lower surface and a thickness therebetween, and a cylindrical inner bore, the diameter of the inner bore being sufficiently larger than the outer diameter of the slide pipe such that the slide pipe may be inserted through the inner bore, free to move slidably through the bore;

c) a cylindrical seal of resilient material, coaxially located between the upper flange and the lower flange, and extending into the inner bore of the lower flange, having an upper surface and a lower surface and a thickness therebetween, and a cylindrical inner bore, the diameter of the inner bore being sufficiently larger than the outer diameter of the slide pipe such that the slide pipe may be inserted through the inner bore, free to move slidably through the bore; the outer diameter of the cylindrical seal being tapered to match the taper of the inner bore of the lower flange; and d) compression means for fastening the upper flange to the lower flange, compressing the resilient seal therebetween, the tapered outer diameter of the resilient seal being pressed by the compression means into the tapered inner bore of the lower flange, such that the inner bore of the resilient seal is pressed against the outer diameter of the slide pipe.

7. The seal assembly of claim 6, in which the resilient material of the cylindrical seal is rubber.

8. The seal assembly of claim 6, in which the resilient material of the cylindrical seal is neoprene.

9. The seal assembly of claim 6, in which the cylindrical seal is a mechanical joint pipe gasket.

10. The seal assembly of claim 6, in which the inner bore of the lower flange and the outer diameter of the cylindrical seal are tapered at an angle of approximately 28° to the axis of the inner bore.

* * * * *